US006828954B2

(12) United States Patent
Yoshihara et al.

(10) Patent No.: US 6,828,954 B2
(45) Date of Patent: Dec. 7, 2004

(54) LIQUID CRYSTAL DISPLAY DEVICE

(75) Inventors: Toshiaki Yoshihara, Kawasaki (JP); Tetsuya Makino, Kawasaki (JP); Hironori Shiroto, Kawasaki (JP); Yoshinori Kiyota, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 446 days.

(21) Appl. No.: 09/799,908

(22) Filed: Mar. 6, 2001

(65) Prior Publication Data

US 2001/0052891 A1 Dec. 20, 2001

Related U.S. Application Data

(63) Continuation of application No. PCT/JP99/06067, filed on Oct. 29, 1999.

(30) Foreign Application Priority Data

Nov. 13, 1998 (JP) ..... 10-323570

(51) Int. Cl.[7] ..... G09G 3/36

(52) U.S. Cl. ..... 345/102; 345/88; 345/103; 349/61

(58) Field of Search ..... 345/87, 88, 102, 345/103; 349/61, 68, 64, 73, 74, 80

(56) References Cited

U.S. PATENT DOCUMENTS 5,337,068 A * 8/1994 Stewart et al. ..... 345/88
5,727,107 A * 3/1998 Umemoto et al. ..... 385/116
5,835,173 A * 11/1998 Inbar et al. ..... 349/61
6,111,560 A * 8/2000 May ..... 345/102

FOREIGN PATENT DOCUMENTS

| | | |
|---|---|---|
| JP | 62-131232 | 6/1987 |
| JP | 63-85525 | 4/1988 |
| JP | 403198026 | * 8/1991 |
| JP | 05-080716 | 4/1993 |
| JP | 07-146467 | 6/1995 |
| JP | 7-281150 | 10/1995 |
| JP | 09-033886 | 2/1997 |
| JP | 10-239659 | 9/1998 |

* cited by examiner

*Primary Examiner*—Dennis-Doon Chow
(74) *Attorney, Agent, or Firm*—Greer, Burns & Crain, Ltd.

(57) ABSTRACT

A liquid crystal display device including a liquid crystal panel having a plurality of liquid crystal pixels and a plurality of switching elements provided to correspond to the respective liquid crystal pixels; a back-light, disposed on the rear face of the liquid crystal panel, for emitting red, green and blue lights in a time-divided manner; and a data driver and a scan driver for switching the respective switching elements according to red, green and blue data of the respective pixels, in which the light emitting area of the back-light is divided into a plurality of light emitting areas and the intensity of light to be emitted from each of the divided light emitting areas is adjusted by a back-light control circuit and drive power source so as to compensate for differences in the light transmittance of the liquid crystal panel.

20 Claims, 10 Drawing Sheets

LIQUID CRYSTAL DISPLAY DEVICE

This application is a continuation of PCT/JP99/06067 Oct. 29, 1999.

TECHNICAL FIELD

The present invention relates to a liquid crystal display device of a color light source type for providing a full-color display by causing a back-light to emit three colored lights in a time-divided manner.

BACKGROUND ART

Along with the recent developments of so-called office automation (OA), OA apparatuses such as word processors and personal computers have been widely used. Further, as such OA apparatuses have become prevalent in portable-type OA apparatuses that can be used in offices as well as outdoors, there have been demands for small-size and light-weight apparatuses. Liquid crystal display devices have been widely used as one of the means to meet such demands. In particular, liquid crystal display devices not only achieve small size and light weight, but also include an indispensable technique in an attempt to achieve low power consumption in portable OA apparatuses that are driven by batteries.

By the way, the liquid crystal display devices are roughly classified into the reflection type and the transmission type. The reflection type liquid crystal display devices are constructed so that light rays incident on the front face of a liquid crystal panel are reflected by the rear face of the liquid crystal panel and an image is visualized by the reflected light, while the transmission type liquid crystal display devices are constructed so that an image is visualized by transmitted light from a light source (back-light) provided on the rear face of the liquid crystal panel. Although the reflection type liquid crystal display devices have poor visibility resulting from the reflected light amount varying depending on environmental conditions, they have been widely used as monochrome (such as black-and-white) display devices for portable calculators, watches, etc. because of their low costs, but they are not suitable for the display devices of personal computers, etc. providing a multi-color or full-color display. For this reason, in general, transmission type liquid crystal display devices are used as display devices of personal computers, etc. providing a multi-color or full-color display.

Meanwhile, currently-used color liquid crystal display devices are generally classified into the STN (Super Twisted Nematic) type and the TFT-TN (Thin Film Transistor-Twisted Nematic) type based on the liquid crystal materials to be used. The STN type liquid crystal display devices have comparatively low production costs, but they are not suitable for the display of a moving image because they are susceptible to crosstalk and comparatively slow in the response rate. In contrast, the TFT-TN type liquid crystal display devices have better display quality than the STN type, but they require a back-light with high intensity because the transmittance of the liquid crystal panel is only 4% or so at present. For this reason, in the TFT-TN type liquid crystal display devices, a lot of power is consumed by the back-light, and there would be a problem when used with a battery power source. The TFT-TN type liquid crystal display devices have also problems such as a low response rate, particularly in displaying half tones, a narrow viewing angle, and a difficult color balance adjustment.

Additionally, conventional transmission type liquid crystal display devices are generally of the color-filter type which uses a back-light of white light and is designed to provide a multi-color or full-color display by selectively transmitting white light through color filters of the three primary colors. However, in such a color-filter type, since a display pixel is formed by a certain area including adjacent three color filters as one unit, the resolution is lowered to virtually one-third.

In view of the above-mentioned problems, there has been proposed a color liquid crystal display device (Japanese Patent Application Laid-Open No. 7-281150, etc.) which uses a ferroelectric liquid crystal element or an anti-ferroelectric liquid crystal element having a high response speed with respect to an applied electric field as its liquid crystal element and causes the same pixel to emit lights of the three primary colors in a time-divided manner so as not to cause a substantial lowering of the resolution.

With this color liquid crystal display device, it is possible to provide a color display by combining a liquid crystal panel using a ferroelectric liquid crystal element or an anti-ferroelectric liquid crystal element capable of responding at a high speed of several hundreds to several $\mu$ order with a back-light capable of emitting lights of red, green and blue colors in a time-divided manner and by synchronizing the switching of the liquid crystal element with the light emission of the back-light. In the case where a ferroelectric liquid crystal or an anti-ferroelectric liquid crystal is used as the liquid crystal material, since the liquid crystal molecules are constantly maintained parallel to the substrate (glass substrate) regardless of the presence or absence of an applied voltage, a very wide viewing angle is obtained, and thus no problem arises in practical use. Moreover, in the case where a back-light constituted by red, green and blue light-emitting diodes (LEDs) is used, it is possible to adjust the color balance by controlling a current flowing through each LED.

FIG. 1 is a time chart showing one example of conventional display control in such a color liquid crystal display device, wherein FIG. 1(*a*) indicates the light-emitting timing of the LEDs of the respective colors of the back-light and FIG. 1(*b*) shows the scanning timing of the respective lines of the liquid crystal panel.

As shown in FIG. 1(*a*), the LEDs of the back-light are caused to emit red, green and blue lights sequentially in this order every 5.6 ms, for example, and the pixels of the liquid crystal panel are switched on a line by line basis in synchronism with the light emission so as to provide a display. Besides, in the case where 60 frames are displayed in one second, one frame period is 16.6 ms, and this one frame period is further divided into three sub-frames, each having a period of 5.6 ms, so that in the case illustrated in FIG. 1(*a*), for example, the red LED, the green LED and the blue LED emit light in the first sub-frame, the second sub-frame and the third sub-frame, respectively.

Meanwhile, as shown in FIG. 1(*b*), with respect to the liquid crystal panel, data scanning is performed twice within each of the sub-frames of the respective red, green and blue colors. However, timing adjustments are performed so that the start timing (timing for the first line) of the first scanning (data-writing scanning) coincides with the start timing of each sub-frame and the end timing (timing for the final line) of the second scanning (data-erasing scanning) coincides with the end timing of each sub-frame.

During the data-writing scanning, a voltage corresponding to pixel data is supplied to each pixel of the liquid crystal panel so as to adjust the transmittance. It is thus possible to provide a full-color display. During the data-erasing scanning, a voltage which is the same as the voltage for the data-writing scanning but has opposite polarity is supplied to each pixel of the liquid crystal panel so as to erase the display of the pixels of the liquid crystal panel, thereby preventing application of a direct-current component to the liquid crystal.

By the way, in such a liquid crystal panel, the intensity of the transmitted light varies according to write/erasure scanning of the liquid crystal panel. In other words, it has been confirmed by experiments that, even when the same voltage is applied, there is a difference in the light transmittance between the scanning start area and the scanning end area because of a problem associated with the liquid crystal panel's own characteristics. FIGS. 2 and 3 are illustrations for explaining such a phenomenon: FIG. 2 shows the respective areas (areas 1–4) given by virtually dividing the display area of the liquid crystal panel into four areas together with the scanning direction; and FIG. 3 is a graph showing the applied voltage-light transmittance characteristics in the respective divided areas. Even when the same voltage is applied, the light transmittance becomes the largest in the area 1 located on the scanning start side, decreases gradually toward the downstream side of scanning, and becomes the smallest in the area 4 located on the scanning end side. Thus, there is a problem that the luminance is inconsistent within the entire display area.

The present invention was invented in view of such circumstances, and its object is to provide a liquid crystal display device having no inconsistency in the display luminance.

Another object of the present invention is to provide a liquid crystal display device capable of readily and selectively making the luminance in a certain display area higher than in other display areas without causing a considerable increase in power consumption.

DISCLOSURE OF THE INVENTION

A liquid crystal display device of the first aspect comprises: a liquid crystal panel having a plurality of liquid crystal pixels and a plurality of switching elements provided to correspond to the respective liquid crystal pixels; a back-light, disposed on the rear face of the liquid crystal panel, for emitting three colored lights in a time-divided manner; and a controller for providing a color display by driving the switching elements to be on/off according to data of three colors of the respective liquid crystal pixels, causing the back-light to emit the lights in a time-divided manner in synchronism with the on/off driving and scanning the respective liquid crystal pixels during the emission of the lights in a time-divided manner, wherein the light emitting area of the back-light is divided into a plurality of areas, and the intensity of light to be emitted from each of the divided light emitting areas differs from each other.

In the liquid crystal display device of the first aspect, the light emitting area of the back-light capable of emitting the three colored lights separately is divided into at least two areas, and the intensity of light to be emitted from each of the areas is arranged not to be the same. With scanning of the liquid crystal panel, the light transmittance in the display area of the liquid crystal panel varies. Therefore, the intensity of light to be emitted by the back-light is increased in an area corresponding to a display area with a low light transmittance, while the intensity of light is decreased in an area corresponding to a display area with a high light transmittance. Accordingly, even when there is a difference in the light transmittance, the display luminance becomes uniform over the entire area without causing inconsistency in the luminance.

A liquid crystal display device of the second aspect comprises a switching circuit for switching each of the divided light emitting areas of the back-light to emit light or put out light in synchronism with scanning of each of the liquid crystal pixels.

In the liquid crystal display device of the second aspect, the light-emitting timing in each of the light emitting areas of the back-light is controlled in synchronism with scanning of the liquid crystal panel. Therefore, by causing each of the light emitting areas to emit light only in a necessary period, it is possible to improve the utilization efficiency of the back-light.

In a liquid crystal display device of the third aspect, the back-light includes a light source divided into parts corresponding to the respective divided light emitting areas.

In the liquid crystal display device of the third aspect, the light source of the back-light is divided into parts corresponding to a plurality of light emitting areas. Therefore, by adjusting the intensity of light of each light source, it is possible to readily control the intensity of light to be emitted.

A liquid crystal display device of the fourth aspect comprises a control circuit for controlling the intensity of light to be emitted from each of the divided light emitting areas of the back-light in synchronism with scanning of each of the liquid crystal pixels.

In the liquid crystal display device of the fourth aspect, the intensity of light to be emitted from each of the light emitting areas of the back-light is controlled in synchronism with scanning of the liquid crystal panel. It is therefore possible to compensate for differences in the light transmittance resulting from scanning of the liquid crystal panel.

A liquid crystal display device of the fifth aspect comprises a control circuit for controlling the intensity of light to be emitted from each of the divided light emitting areas of the back-light according to a light transmittance of each of display areas of the liquid crystal panel corresponding to each of the divided light emitting areas.

In the liquid crystal display device of the fifth aspect, the intensity of light to be emitted from each of the divided light emitting areas of the back-light is controlled according to the light transmittance of the liquid crystal panel. It is therefore possible to accurately compensate for differences in the light transmittance resulting from scanning of the liquid crystal panel. Moreover, it is possible to readily achieve a higher luminance in a certain display area than in other display areas without causing a considerable increase in power consumption.

In a liquid crystal display device of the sixth aspect, the light-emitting time of each of the three colored lights is not more than $1/180$ second.

In the liquid crystal display device of the sixth aspect, the image display of one frame is completed within a time of not more than $1/60$ second, thereby enabling display of 60 or more frames per second.

In a liquid crystal display device of the seventh aspect, the back-light comprises LEDs for emitting three colored lights, respectively, a diffusing plate for diffusing light emitted by the LEDs, and a light guiding plate for guiding light emitted by the LEDs to one face of the liquid crystal panel.

In the liquid crystal display device of the seventh aspect, since the back-light is composed of the LEDs of the respective three colors (red, green and blue), the diffusing plate for diffusing light emitted by the respective LEDs and the light guiding plate for guiding light emitted by the respective LEDs to one face of the liquid crystal panel, the transmitted light from the back-light is uniform.

In a liquid crystal display device of the eighth aspect, a liquid crystal material of the liquid crystal panel is a ferroelectric liquid crystal material or an antiferroelectric liquid crystal material.

In the liquid crystal display device of the eighth aspect, since the liquid crystal material is a ferroelectric liquid crystal material or an antiferroelectric liquid crystal material, it is possible to perform high-speed on/off control and sufficiently correspond to control of the light emission of the back-light.

BRIEF DESCRIPTION OF THE DRAWINGS

FIG. 1(*b*) shows the scanning timing of the respective lines of the liquid crystal panel;

FIG. 9(*b*) shows data write scanning being perform twice in each of the sub-frames of the respective red, green, and blue colors by the data driver and the scan driver;

FIG. 10(*b*) shows the scanning of the liquid crystal panel.

PREFERRED EMBODIMENTS OF THE INVENTION

The following description will explain the present invention with reference to the drawings illustrating the embodiments thereof.

Figure 1:
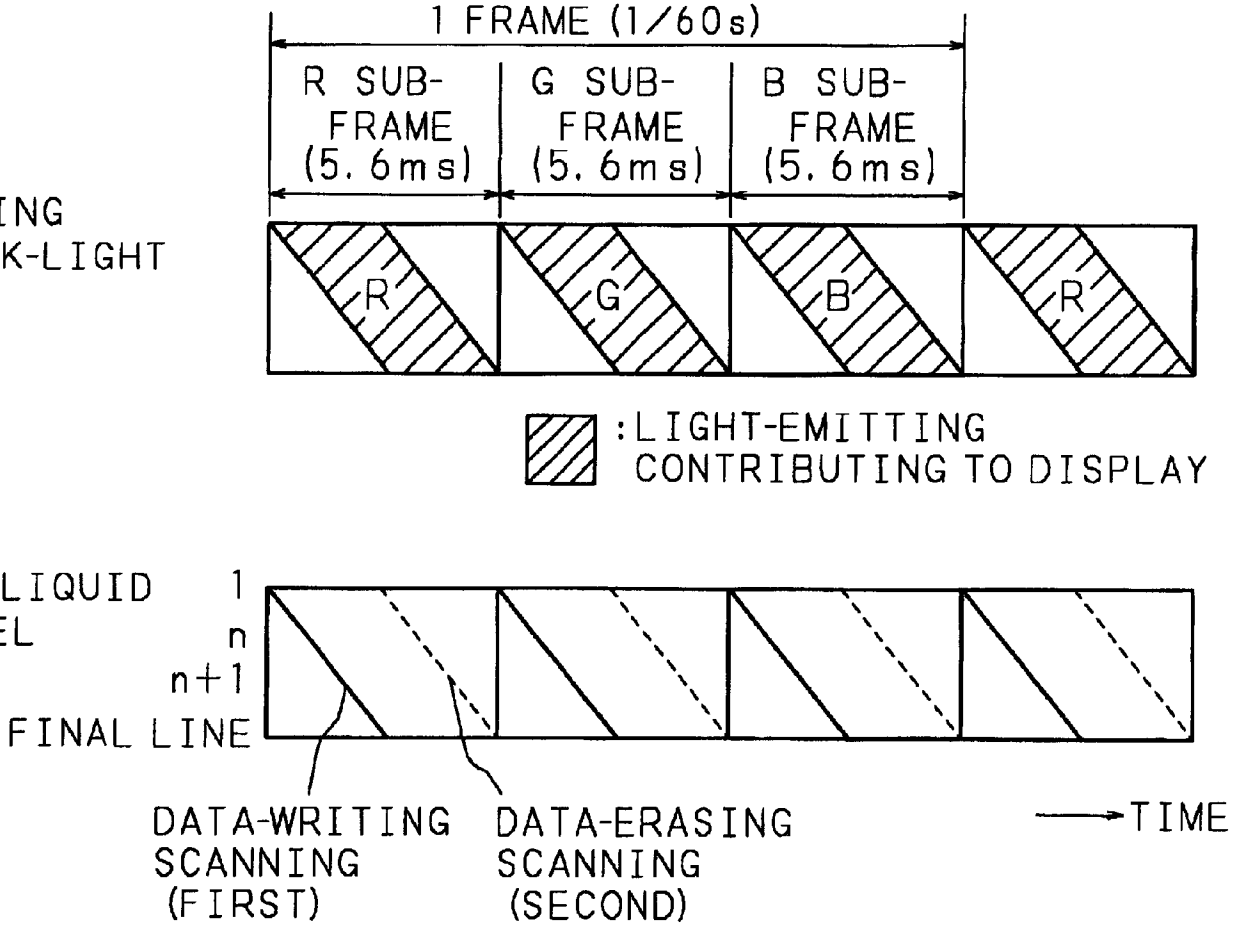
FIG. 1 PRIOR ART
FIG. 1(*a*) shows a light-emitting timing of the LEDs for the respective colors of the back-light.
Figure 2:
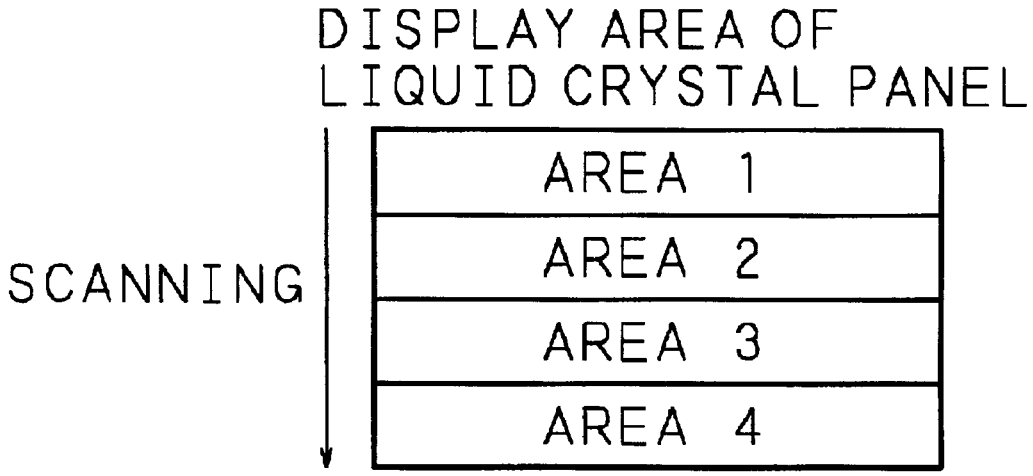
FIG. 2 PRIOR ART
FIG. 2 is a schematic diagram showing a divided state of the display area of a liquid crystal panel in order to explain the problems of the conventional liquid crystal display device.
Figure 3:
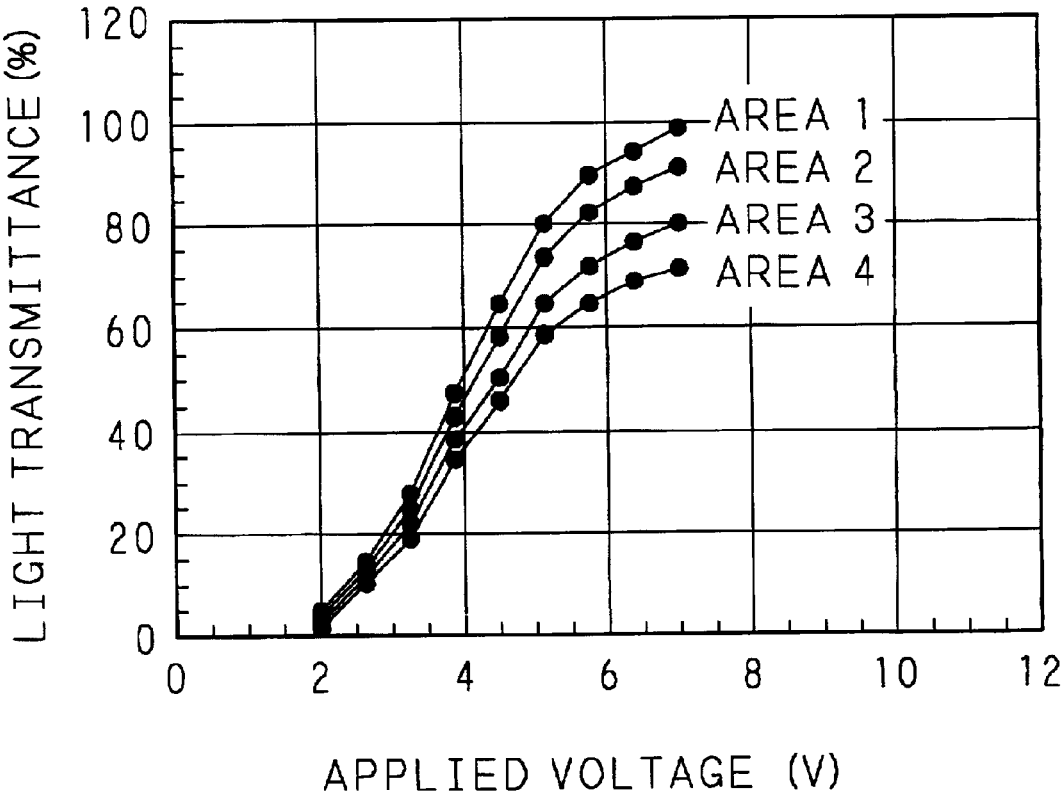
FIG. 3 PRIOR ART
FIG. 3 is a graph showing the applied voltage-light transmittance characteristics in the display area of the liquid crystal panel in order to explain the problems of the conventional liquid crystal display device.
Figure 4:
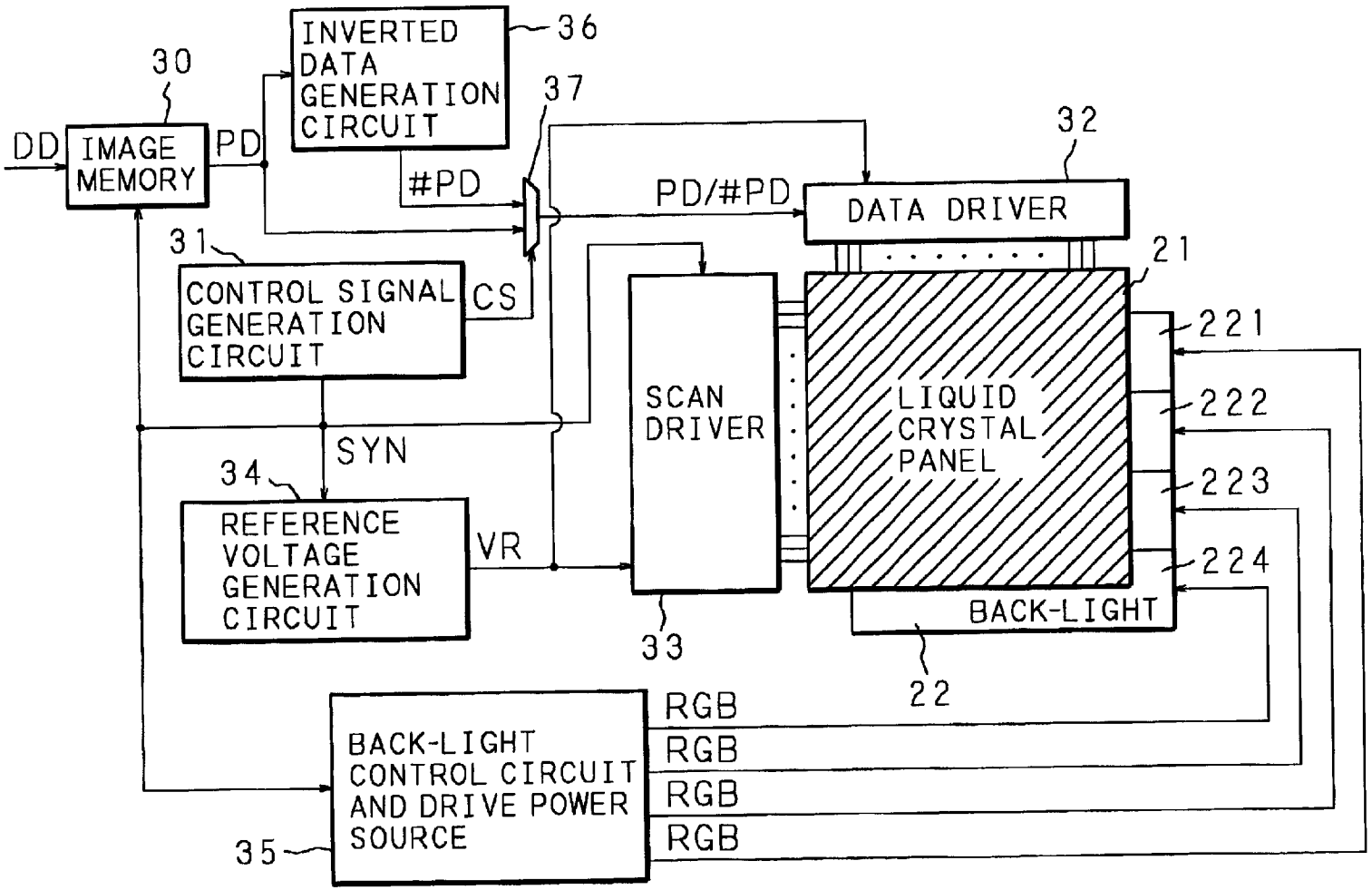
FIG. 4 is a block diagram showing an example of a whole liquid crystal display device of the present invention.
Figure 5:
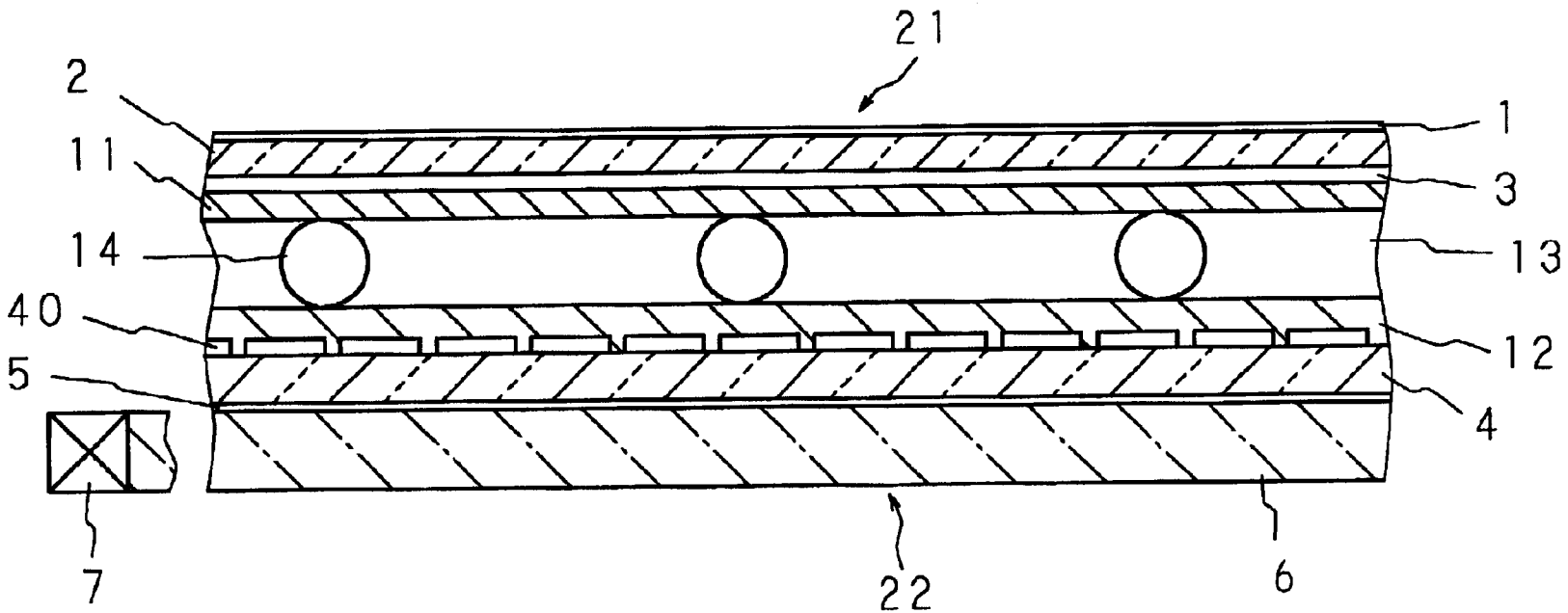
FIG. 5 is a schematic cross sectional view of a liquid crystal panel and a back-light for use in the liquid crystal display device of the present invention.
Figure 6:
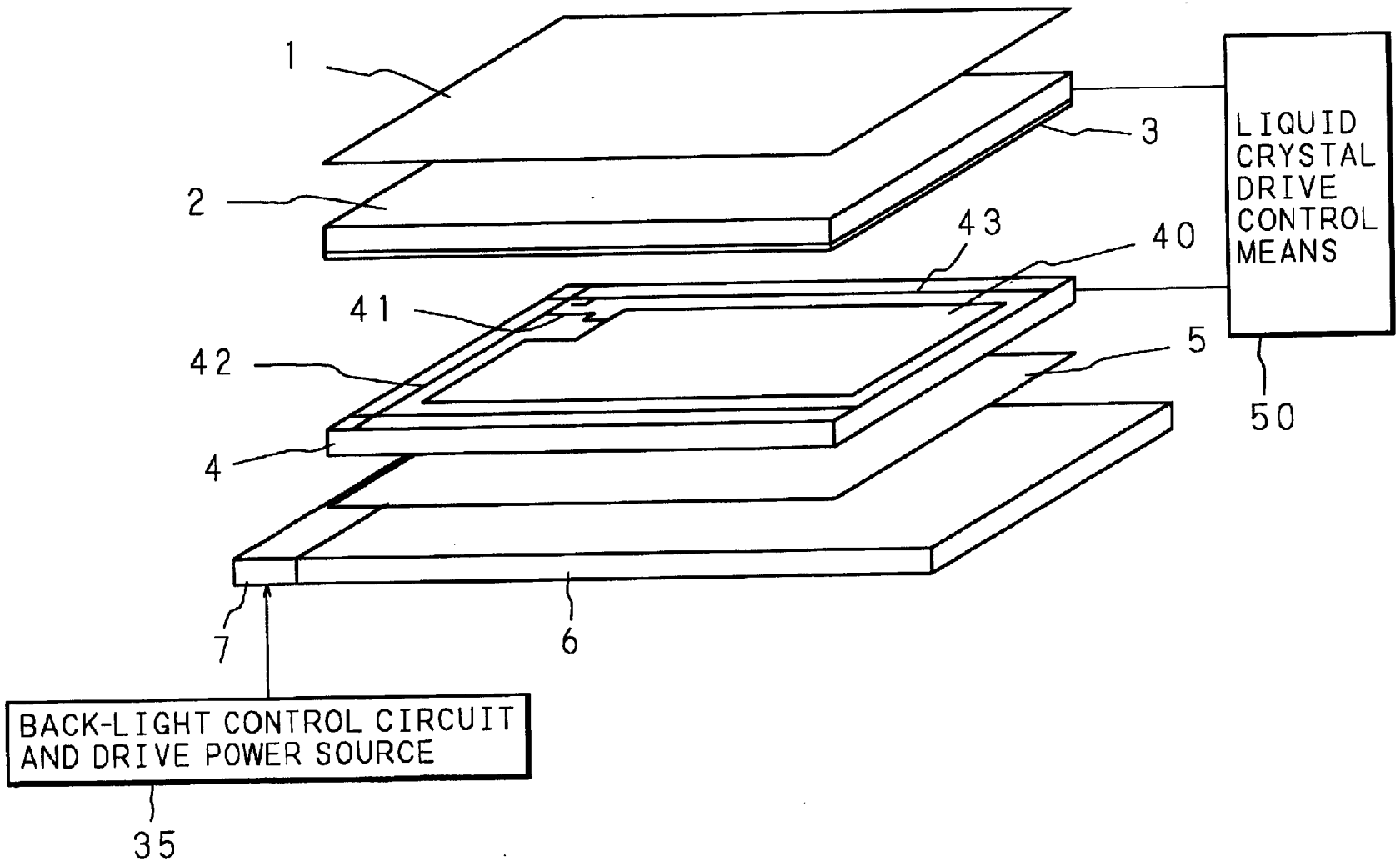
FIG. 6 is a schematic diagram showing an example of the entire structure of the liquid crystal display device of the present invention.
Figure 7:
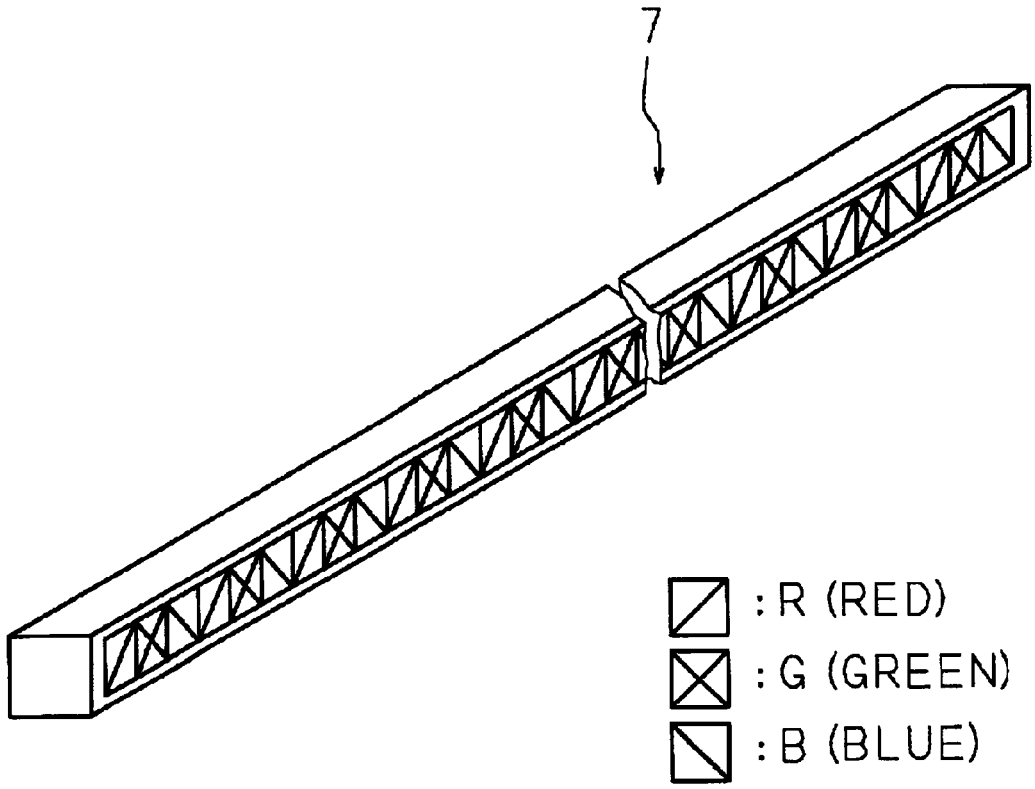
FIG. 7 is a schematic diagram showing an example of the structure of an LED array.

FIG. 4 is block diagram showing an example of a whole liquid crystal display device of the present invention; FIG. 5 is a schematic cross sectional view of a liquid crystal panel and a back-light thereof; FIG. 6 is a schematic perspective view showing an example of the structure of the liquid crystal panel and the back-light; and FIG. 7 is a schematic diagram showing an example of the structure of an LED array as a light source of the back-light.

In FIG. 4, 21 and 22 represent the liquid crystal panel and the back-light, respectively, whose cross sectional structure is shown in FIG. 5. As shown in FIG. 5, the back-light 22 is constituted by an LED array 7 and a light guiding plate+light diffusing plate 6.

As shown in FIGS. 5 and 6, the liquid crystal panel 21 is constructed as a structure between two polarizing films 1 and 5. More specifically, the liquid crystal panel 21 is constructed by stacking the polarizing film 1, a glass substrate 2, a common electrode 3, a glass substrate 4 and the polarizing film 5 in this order from the upper side to the lower side, and pixel electrodes 40 corresponding to individual display pixels arranged in a matrix form are formed on the common electrode 3 side of the glass substrate 4. These common electrode 3 and pixel electrodes 40 are connected with later-described liquid crystal drive control means 50 including a data driver 32 and a scan driver 33. Further, each pixel electrode 40 is controlled to be on/off by a TFT (Thin Film Transistor)) 41, and each TFT 41 is driven by selectively switching on/off a signal line 42 and a scanning line 43 by the data driver 32 and the scan driver 33, respectively. Then, the intensity of the transmitted light of each pixel is controlled by a signal from the signal line 42.

An alignment film 12 is placed on the upper face of the pixel electrodes 40 on the glass substrate 4, and an alignment film 11 is provided on the lower face of the common electrode 3. A liquid crystal material is filled between the alignment films 11 and 12 to form a liquid crystal layer 13. Here, 14 indicates spacers for suitably maintaining the layer thickness of the liquid crystal layer 13.

The back-light 22 is disposed on the lower layer (rear face) side of the liquid crystal panel 21, and provided with the LED array 7 protruding from one side of the light guiding plate+light diffusing plate 6 that constitutes a light emitting area. As illustrated in FIG. 7 showing a schematic diagram of the LED array 7, this LED array 7 includes LEDs which emit lights of the three primary colors, namely red (R), green (G) and blue (B), and are arranged sequentially and repeatedly on the face facing the light-guiding plate+light diffusing plate 6. The light-guiding plate+light diffusing plate 6 guides light emitted from each of the LEDs of the LED array 7 through its entire surface and diffuses it toward the upper face, thereby functioning as the light emitting area.

In FIG. 4, display data DD to be displayed on the liquid crystal panel 21 is supplied to an image memory 30 from an external device, for example, a personal computer. After temporarily storing this display data DD, the image memory 30 outputs respective pixel unit data (hereinafter referred to as the pixel data PD) in synchronism with a synchronous signal SYN generated by a control signal generation circuit 31. The pixel data PD outputted from the image memory 30 is inputted as it is to a selector 37 and also to an inverted data generation circuit 36.

The inverted data generation circuit 36 is a circuit for generating the inverted data of the pixel data PD outputted from the image memory 30, and its output signal is supplied as the inverted pixel data #PD to the selector 37. Therefore, the pixel data PD outputted from the image memory 30 and the inverted pixel data #PD outputted from the inverted data generation circuit 36 are inputted to the selector 37, and the selector 37 outputs either of the data to the data driver 32 according to a control signal CS supplied from the control signal generation circuit 31. The data driver 32 controls the signal lines of the pixel electrodes 40 to be on/off according to the pixel data PD or the inverted pixel data #PD outputted from the selector 37.

The synchronous signal SYN generated by the control signal generation circuit 31 is also supplied to the scan driver 33, a reference voltage generation circuit 34, and a back-light control circuit and drive power source 35. The scan drive 33 controls the scanning lines of the pixel electrodes 40 to be on/off in synchronism with the synchronous signal SYN. Meanwhile, the reference voltage generation circuit 34 generates a reference voltage VR in synchronism with the synchronous signal SYN and supplies it to the data driver 32 and the scan driver 33. The back-light control circuit and drive power source 35 supplies a drive voltage to the back-light 22 in synchronism with the synchronous signal SYN so as to cause the LED array 7 of the back-light 22 to emit light.

In the present invention, the light emitting area of the back-light 22 is divided into four light emitting areas 221, 222, 223, 224 along a line direction of the liquid crystal panel 21, and the timing, color and intensity of light to be emitted from each of these light emitting areas 221, 222, 223, 224 are independently controlled by the back-light control circuit and drive power source 35.

Figure 8:
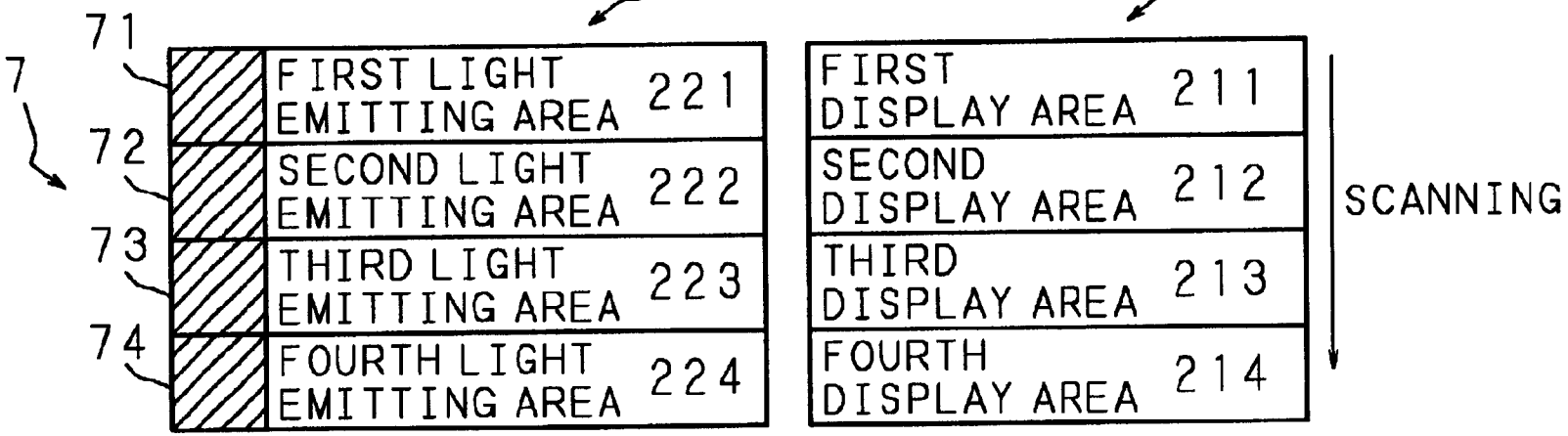
FIG. 8 is a schematic diagram showing a divided state of the light emitting area of the back-light, the LED array and the display area of the liquid crystal panel.

In accordance with such four divisions of the light emitting area of the back-light 22, the LED array 7 is also divided into four areas, and further the display area of the liquid crystal panel 21 is virtually divided into four areas. FIG. 8 is a schematic diagram showing the relationship among these divisions. The light emitting area of the back-light 22 is divided into four areas: the first light emitting area 221 through the fourth light emitting area 224, and accordingly the LED array 7 is divided into four areas: the first LED array block 71 through the fourth LED array block 74, and the display area of the liquid crystal panel 21 is divided into four areas: the first display area 211 through the fourth display area 214. The first light emitting area 221 is controlled for light emission by the first LED array block 71 to illuminate the first display area 211. Moreover, the second light emitting area 221 is controlled for light emission by the second LED array block 72 to illuminate the second display area 212. Besides, the third light emitting area 223 is controlled for light emission by the third LED array block 73 to illuminate the third display area 213. Furthermore, the fourth light emitting area 224 is controlled for light emission by the fourth LED array block 74 to illuminate the fourth display area 214.

In the present invention, the intensity of light to be emitted from each of the light emitting areas 221, 222, 223, 224 differs from each other. It is therefore possible to eliminate inconsistency in the luminance in the display area of the liquid crystal panel 21 by controlling the intensity of light to be emitted from each of the light emitting areas 221, 222, 223, 224 according to the light transmittance in the corresponding display areas 211, 212, 213, 214. Moreover, it is possible to make the intensity of light to be emitted from any one of the light emitting areas 221, 222, 223, 224 higher than that in the other light emitting areas so as to selectively make only the luminance in the corresponding display area higher than the luminance in other display areas.

Furthermore, in order to make the intensity of light to be emitted from the respective light emitting areas 221, 222, 223, 224 different from each other, the intensity of light to be emitted from the LED array blocks 71, 72, 73, 74 corresponding to the light emitting areas 221, 222, 223, 224, respectively, may be made different from each other, and the difference in the intensity of light to be emitted may be realized by control of the light guiding plate+light diffusing plate 6.

Figure 9:
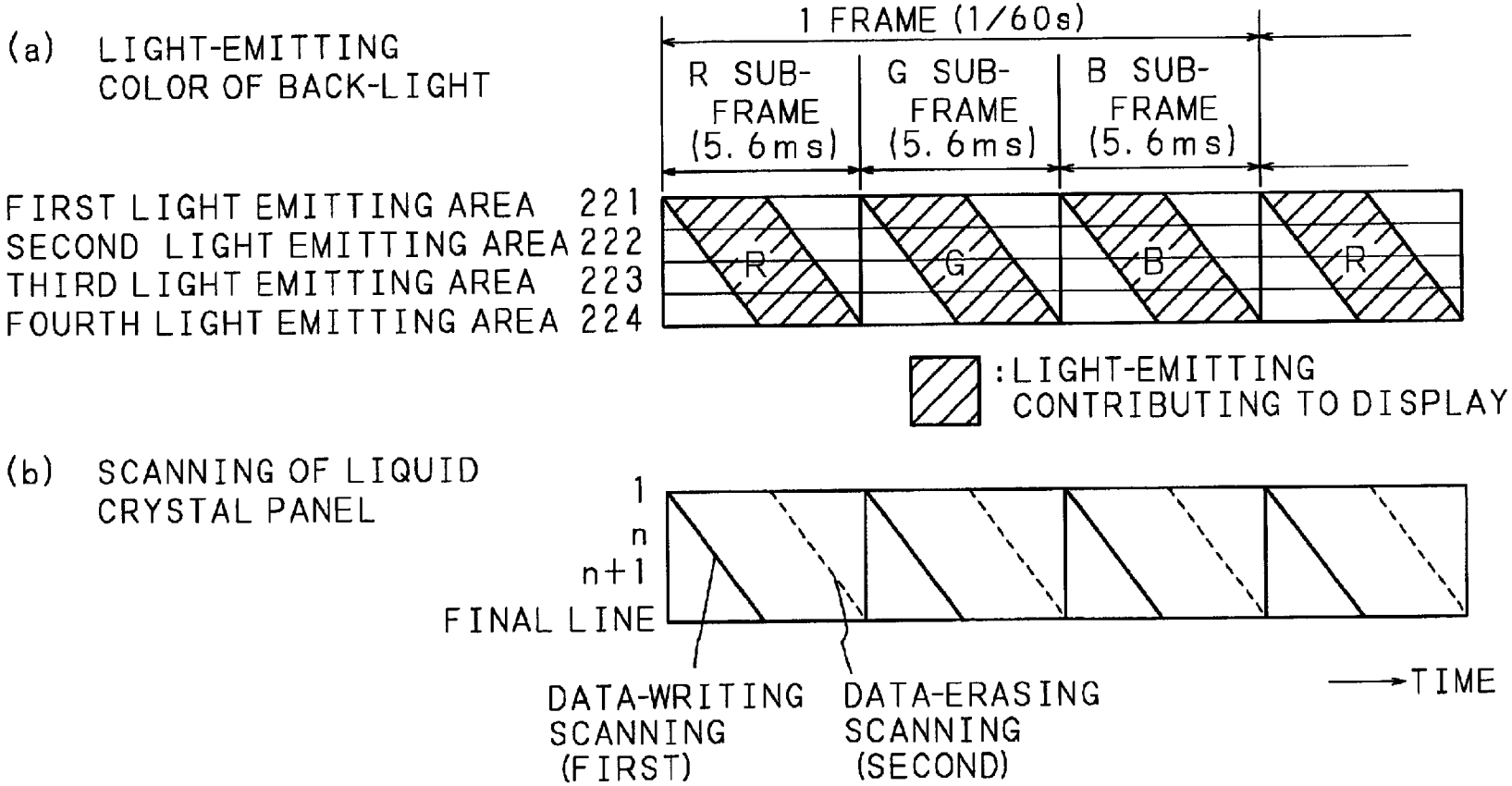
FIG. 9(*a*) is an example of display control in the liquid crystal display device where 60 frames are displayed in one second.

Referring to the time chart of FIG. 9, the following description will explain display control in the liquid crystal display device of the present invention.

As shown in FIG. 9(*a*), for example, in the case where 60 frames are displayed in one second, i.e., one frame period is 16.6 ms, this one frame period is further divided into three sub-frames, each having a period of 5.6 ms, and an image is displayed by sequentially causing the four light emitting areas 221, 222, 223, 224 of the back-light 22 to emit red, green and blue lights in this order for each sub-frame and switching the pixels of the liquid crystal panel 21 on a line by line basis in synchronism with the light emission. Hence, the four light emitting areas 221, 222, 223, 224 of the back-light 22 have the same light-emitting timing, and each light-emitting time is 5.6 ms.

As shown in FIG. 9(*b*), with respect to the liquid crystal panel 21, data write scanning is performed twice in each of the sub-frames of the respective red, green and blue colors by the data driver 32 and the scan driver 33. However, timing adjustments are performed so that the start timing (timing for the first line) of the first scanning (data-writing scanning) coincides with the start timing of each sub-frame and the end timing (timing for the final line) of the second scanning (data-erasing scanning) coincides with the end timing of each sub-frame. Hence, each data-writing/erasing scanning time is 2.8 ms.

Furthermore, in the first write scanning (data-writing scanning), the pixel data PD is outputted from the selector 37 according to the control signal CS of the control signal generation circuit 31, and a signal of a voltage corresponding to this pixel data PD outputted from the selector 37 is supplied from the data driver 32 to each pixel of the liquid crystal panel 21. Accordingly, an electric field is applied, the transmittance is adjusted, and an image corresponding to the pixel data PD is displayed. As a result, a full-color display is provided.

Then, in the second write scanning (data-erasing scanning), the inverted pixel data #PD is outputted from the selector 37 according to the control signal CS of the control signal generation circuit 31, and a signal of a voltage corresponding to this inverted pixel data #PD outputted from the selector 37 is supplied from the data driver 32 to the respective pixels of the liquid crystal panel 21. Accordingly, an electric field having the same strength as and opposite polarity to the electric field applied to the respective pixels during the first write scanning is applied to the respective pixels of the liquid crystal panel 21. Consequently, the display of the pixels of the liquid crystal panel 21 is erased.

The voltage of the signal supplied to the respective pixels of the liquid crystal panel 21 is the same in the magnitude but is different only in the polarity between the first scanning (data-writing scanning) and the second scanning (data-erasing scanning), thereby preventing application of a direct-current component to the liquid crystal.

Figure 10:
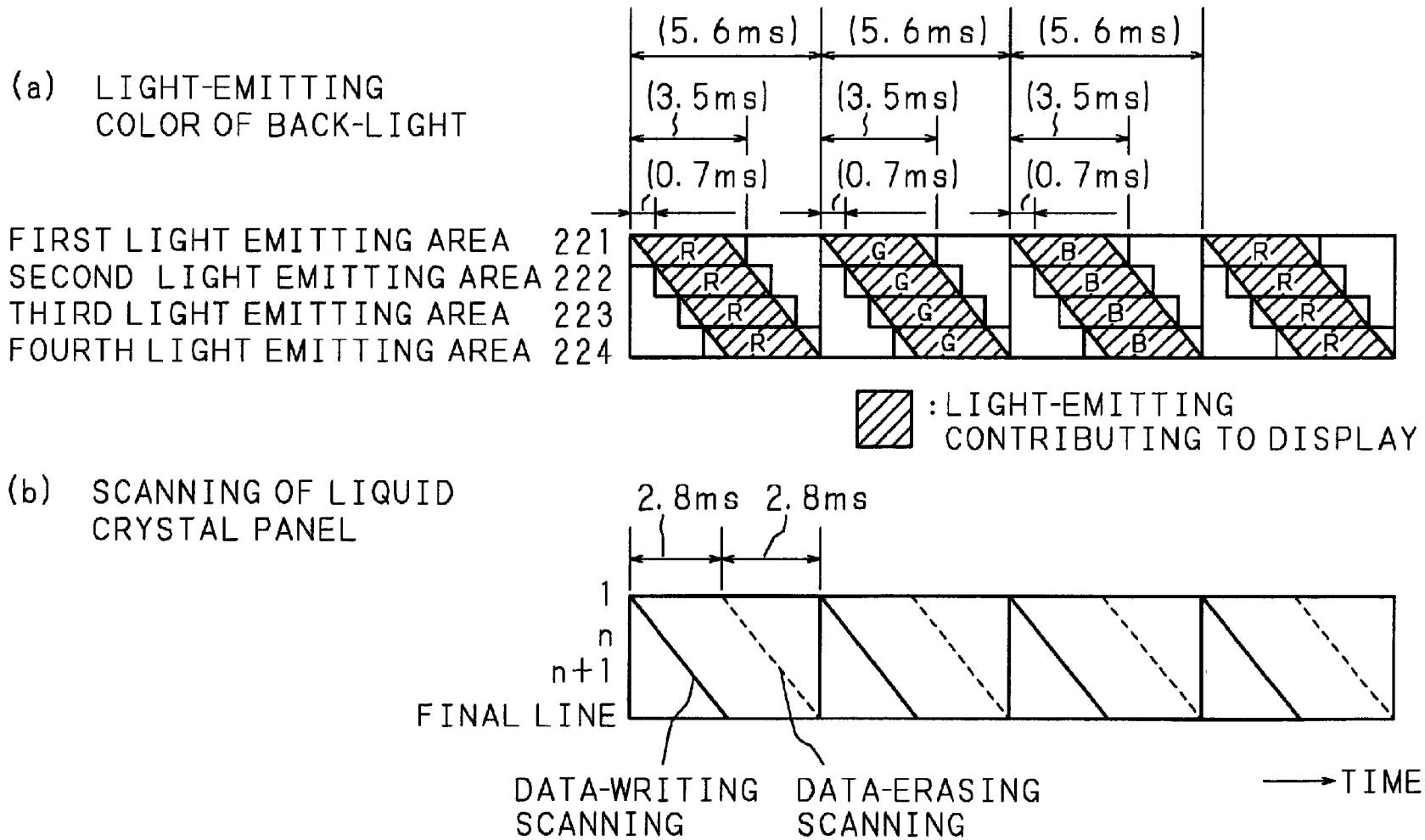
FIG. 10(*a*) shows the first LED array block being caused to emit light in a period during which respective lines in a first display area of the liquid crystal panel corresponding to the first light emitting area of the back-light are being scanned.

FIG. 10 shows a time chart of another display control in the liquid crystal panel of the present invention. In this example of the display control, as shown in FIG. 10, the back-light 22 is caused to emit light and put out light in synchronism with scanning of the liquid crystal panel 21. In other words, the light-emitting timing of the four light emitting areas 221, 222, 223 224 are shifted from each other. More specifically, as shown in FIG. 10(*a*), the first LED array block 71 is caused to emit light in a period during which the respective lines in the first display area 211 of the liquid crystal panel 21 corresponding to the first light emitting area 221 of the back-light 22 are being scanned; the second LED array block 72 is caused to emit light in a period during which the respective lines in the second display area 212 corresponding to the second light emitting area 222 are being scanned; the third LED array block 73 is caused to emit light in a period during which the respective lines in the third display area 213 corresponding to the third light emitting area 223 are being scanned; and the fourth LED array block 74 is caused to emit light in a period during which the respective lines in the fourth display area 214 corresponding to the fourth light emitting area 224 are being scanned.

Therefore, for example, when the period of each of the red, green and blue sub-frames is 5.6 ms and the period of each data-writing/erasing scanning of the liquid crystal panel 21 is 2.8 ms, the light-emitting time in each sub-frame of the light emitting areas 221 through 224 can be 3.5 ms, and thus the utilization efficiency of the back-light 22 can be made higher in comparison with the above-mentioned control example and conventional example, thereby enabling a reduction in power consumption. In this case, the time during which each pixel of the liquid crystal panel 21 is in a display state (data-writing state) is 2.8 ms like the above-mentioned control example and conventional example, and thus having no influence on the display luminance. On the other hand, in a period during which each pixel of the liquid crystal panel 21 is in a non-display state, since a period during which the back-light 22 puts out light is longer, it is possible to achieve an improvement in the contrast ratio.

Next, specific examples of the present invention will be explained.

EXAMPLE 1

First, the liquid crystal panel 21 shown in FIGS. 5 and 6 was formed as follows. A TFT substrate was fabricated by arranging individual pixel electrodes 40 with pitches of 0.24 mm×0.24 mm to form a matrix consisting of 1024×768 pixels with a diagonal length of 12.1 inches. After washing such a TFT substrate and the glass substrate 2 having the common electrode 3, they were coated with polyamide by using a spin coater and then baked for one hour at 200° C. To form the alignment films 11 and 12 made of about 200 Å thick polyimide films.

Further, these alignment films 11 and 12 were rubbed with a cloth made of rayon, and stacked with a gap being maintained therebetween by the spacers 14 made of silica having an average particle size of 1.6 $\mu$m so as to fabricate an empty panel. A ferroelectric liquid crystal composed mainly of a naphthalene-series liquid crystal was sealed between the alignment films 11 and 12 of this empty panel so as to form the liquid crystal layer 13. The panel thus fabricated was sandwiched by two polarizing films (NSF-EG1225DU: available from Nitto Denko Corporation) 1 and 5 maintained in a crossed-Nicol state so that a dark state could be produced when the ferroelectric liquid crystal molecules of the liquid crystal layer 13 titled to one direction, thereby forming the liquid crystal panel 21.

This liquid crystal panel 21 and the back-light 22, which was capable of emitting red, green and blue lights in a time-divided manner and had a light emitting area divided into four areas, were stacked. The timing, intensity and color of light to be emitted by the back-light 22 were controlled in synchronism with the data-writing/erasing scanning of the liquid crystal panel 21.

Then, the average applied voltage-light transmittance characteristics of the four display areas 211, 212, 213, 214 of the liquid crystal panel 21 corresponding to the four divided light emitting areas 221, 222, 223, 224 of the back-light 22 were measured, and the intensity of light to be emitted from the respective light emitting areas 221, 222, 223, 224 was adjusted according to the measured characteristics.

The back-light 22 was caused to emit light and put out light repeatedly by controlling the individual light emitting areas of the back-light 22 and the color of light to be emitted therefrom in synchronous with data-writing/erasing scanning of the liquid crystal panel 21 so as to provide a time-division color display. In this time-division color display, the time of each of the red, green and blue sub-frames was 5.6 ms, and the time of each data-writing/erasing scanning of the liquid crystal panel 21 was 2.8 ms. In such a state, the luminance in the white display was measured for the respective four display areas 211, 212, 213, 214 of the liquid crystal panel 21. The results of the measurements are shown in Table 1.

TABLE 1

| Display area | Luminance (cd/cm$^2$) |
|---|---|
| First display area 211 | 195 |
| Second display area 212 | 190 |
| Third display area 213 | 195 |
| Fourth display area 214 | 196 |

As shown in Table 1, it was possible to provide a clear color display with a small inconsistency in the luminance and excellent color purity. In this case, the power consumption was 21 W.

COMPARATIVE EXAMPLE 1

A liquid crystal panel 21 similar to the above-mentioned Example 1 and a back-light 22 whose light emitting area was divided into four areas like the above-mentioned Example 1 were stacked. However, the intensity of light to be emitted from the respective light emitting areas of the back-light 22 was made equal to each other. Then, the back-light 22 was caused to emit light and put out light repeatedly by controlling the individual light emitting areas thereof and the color of light to be emitted therefrom in synchronous with data-writing/erasing scanning of the liquid crystal panel 21 so as to provide a time-division color display. In this time-division color display, the time of each of the red, green and blue sub-frames was 5.6 ms, and the time of each data-writing/erasing scanning of the liquid crystal panel 21 was 2.8 ms. In such a state, the luminance in the white display was measured for the respective four display areas 211, 212, 213, 214 of the liquid crystal panel 21. The results of the measurements are shown in Table 2. As shown in Table 2, there was a large inconsistency in the luminance.

TABLE 2

| Display area | Luminance (cd/cm$^2$) |
|---|---|
| First display area 211 | 195 |
| Second display area 212 | 183 |
| Third display area 213 | 168 |
| Fourth display area 214 | 159 |

EXAMPLE 2

First, the liquid crystal panel 21 shown in FIGS. 5 and 6 was formed as follows. A TFT substrate was fabricated by arranging individual pixel electrodes 40 with pitches of 0.24 mm×0.24 mm to form a matrix consisting of 1024×768 pixels with a diagonal length of 12.1 inches. After washing such a TFT substrate and the glass substrate 2 having the common electrode 3, they were coated with polyamide by using a spin coater and then baked for one hour at 200° C. To form the alignment films 11 and 12 made of about 200 Å thick polyimide films.

Further, these alignment films 11 and 12 were rubbed with a cloth made of rayon, and stacked with a gap being maintained therebetween by the spacers 14 made of silica having an average particle size of 1.6 $\mu$m so as to fabricate an empty panel. A ferroelectric liquid crystal composed mainly of a naphthalene-series liquid crystal was sealed between the alignment films 11 and 12 of this empty panel so as to form the liquid crystal layer 13. The panel thus fabricated was sandwiched by two polarizing films (NSF-EG1225DU: available from Nitto Denko Corporation) 1 and 5 maintained in a crossed-Nicol state so that a dark state could be produced when the ferroelectric liquid crystal molecules of the liquid crystal layer 13 titled to one direction, thereby forming the liquid crystal panel 21.

This liquid crystal panel 21 and the back-light 22, which was capable of emitting red, green and blue lights in a time-divided manner and had a light emitting area divided into four areas, were stacked. The light emitting area of the back-light 22 and the color of light to be emitted therefrom were controlled in synchronism with data-writing/erasing scanning of the liquid crystal panel 21.

Then, the average applied voltage-light transmittance characteristics of the four display areas 211, 212, 213, 214 of the liquid crystal panel 21 corresponding to the four divided light emitting areas 221, 222, 223, 224 of the back-light 22 were measured, and the intensity of light to be emitted from the respective light emitting areas 221, 222, 223, 224 was adjusted according to the measured characteristics. Thereafter, only the intensity of light to be emitted from the third light emitting area 223 was increased to a value twice a value given by the adjustment, and the light transmittance of the liquid crystal panel 21 was controlled to be ½ of that in normal driving for color tones other than a color tone to be emphasized. In this example, control was performed so that white was displayed as the emphasized color.

The back-light 22 was caused to emit light and put out light repeatedly by controlling the individual light emitting areas of the back-light 22 and the color of light to be emitted therefrom in synchronous with data-writing/erasing scanning of the liquid crystal panel 21 so as to provide a time-division color display. In this time-division color display, the time of each of the red, green and blue sub-frames was 5.6 ms, and the time of each data-writing/erasing scanning of the liquid crystal panel 21 was 2.8 ms. In such a state, the luminance in the white display was measured for the respective four display areas 211, 212, 213, 214 of the liquid crystal panel 21. The results of the measurements are shown in Table 3.

TABLE 3

| Display area | Luminance (cd/cm$^2$) |
|---|---|
| First display area 211 | 195 |
| Second display area 212 | 193 |
| Third display area 213 | 392 |
| Fourth display area 214 | 193 |

As shown in Table 3, it was possible to provide a liquid crystal display device having a peak luminance of about 400 cd/cm$^2$. In this case, the power consumption was 24 W, and thus this liquid crystal display device required only power as high as about 1.1 times the power, 21 W, consumed by the liquid crystal display device of Example 1 having a peak luminance of about 200 cd/cm$^2$.

COMPARATIVE EXAMPLE 2

A liquid crystal panel 21 similar to the above-mentioned Example 2 and a back-light 22 whose light emitting area was divided into four areas like the above-mentioned Example 2 were stacked. However, the intensity of light to be emitted from the respective light emitting areas of the back-light 22 was made equal to each other and the peak luminance in the white display was adjusted to be about 400 cd/cm$^2$. Then, the back-light 22 was caused to emit light and put out light repeatedly by controlling the individual light emitting areas thereof and the color of light to be emitted therefrom in synchronous with data-writing/erasing scanning of the liquid crystal panel 21 so as to provide a time-division color display. In this time-division color display, the time of each of the red, green and blue sub-frames was 5.6 ms, and the time of each data-writing/erasing scanning of the liquid crystal panel 21 was 2.8 ms. In such a state, the luminance in the white display was measured for the respective four display areas 211, 212, 213, 214 of the liquid crystal panel 21. The results of the measurements are shown in Table 4. In this case, an extremely high power of about 45 W was consumed.

TABLE 4

| Display area | Luminance (cd/cm$^2$) |
|---|---|
| First display area 211 | 392 |
| Second display area 212 | 368 |
| Third display area 213 | 349 |
| Fourth display area 214 | 322 |

Besides, in the above-mentioned examples, while a ferroelectric liquid crystal was used as the liquid crystal material, it is also possible to produce the same effects by using other liquid crystal such as antiferroelectric liquid crystal and nematic liquid crystal. Moreover, in Example 2 mentioned above, while white was displayed as a color tone to be emphasized, it is certainly possible to produce the same effects even when other color is displayed as a color to be emphasized, and further a plurality of colors may be selected as color tones to be emphasized.

In addition, while the light emitting area of the back-light was divided into four areas, this number was merely an example and, needless to say, the light emitting area of the back-light may be divided into any intended number of areas.

INDUSTRIAL APPLICABILITY

As described above, in the liquid crystal display device of the present invention, since the light emitting area of the back-light is divided and the intensity of light to be emitted from each divided light emitting area is controlled according to the light transmittance of the liquid crystal panel, it is possible to reduce the inconsistency in the luminance in the display area. It is also possible to raise the peak luminance without causing a considerable increase in power consumption. Furthermore, since the light-emitting/putting-out timing of each divided light emitting area is controlled in accordance with writing/erasing scanning of the liquid crystal panel, it is possible to increase the utilization efficiency of the back-light.

What is claimed is:

1. A liquid crystal display device comprising a liquid crystal panel having a plurality of liquid crystal pixels and a plurality of switching elements provided to correspond to said respective liquid crystal pixels; and a back-light, disposed in a rear face of said liquid crystal panel, for emitting three colored lights in a time-divided manner, for providing a color display by driving said switching elements to be on/off according to data of three colors of said respective liquid crystal pixels, causng said back-light to emit the lights in a time-divided manner in synchronism with the on/off driving and scanning said respective liquid crystal pixels during the emission of the lights in a time-divided manner, said liquid crystal display device being characterized in that a light emitting area of said back-light is divided into a plurality of areas, and the intensity of light to be emitted from each of the divided light emitting areas differs from each other in accordance with a position of a scanning direction of each of said liquid crystal pixels.

2. The liquid crystal display device as set forth in claim 1, comprising a switching circuit for switching each of the divided light emitting areas of said back-light to emit light or put out light in synchronism with scanning of each of said liquid crystal pixels.

3. The liquid crystal display device as set forth in claim 2, wherein said back-light includes a light source divided into parts corresponding to the respective divided light emitting areas.

4. The liquid crystal display device as set forth in claim 3, comprising a control circuit for controlling the intensity of light to be emitted from each of the divided light emitting areas of said back-light in synchronism with scanning of each of said liquid crystal pixels.

5. The liquid crystal display device as set forth in claim 4, comprising a control circuit for controlling the intensity of light to be emitted from each of the divided light emitting areas of said back-light according to the light transmittance of each of display areas of said liquid crystal panel corresponding to each of the divided light emitting areas.

6. The liquid crystal display device as set forth in claim 3, comprising a control circuit for controlling the intensity of light to be emitted from each of the divided light emitting areas of said back-light according to the light transmittance of each of display areas of said liquid crystal panel corresponding to each of the divided light emitting areas.

7. The liquid crystal display device as set forth in claim 2, comprising a control circuit for controlling the intensity of light to be emitted from each of the divided light emitting areas of said back-light in synchronism with scanning of each of said liquid crystal pixels.

8. The liquid crystal display device as set forth in claim 7, comprising a control circuit for controlling the intensity of light to be emitted from each of the divided light emitting areas of said back-light according to the light transmittance of each of display areas of said liquid crystal panel corresponding to each of the divided light emitting areas.

9. The liquid crystal display device as set forth in claim 2, comprising a control circuit for controlling the intensity of light to be emitted from each of the divided light emitting areas of said back-light according to the light transmittance of each of display areas of said liquid crystal panel corresponding to each of the divided light emitting areas.

10. The liquid crystal display device as set forth in claim 1, wherein said back-light includes a light source divided into parts corresponding to the respective divided light emitting areas.

11. The liquid crystal display device as set forth in claim 10, comprising a control circuit for controlling the intensity of light to be emitted from each of the divided light emitting areas of said back-light in synchronism with scanning of each of said liquid crystal pixels.

12. The liquid crystal display device as set forth in claim 11, comprising a control circuit for controlling the intensity of light to be emitted from each of the divided light emitting areas of said back-light according to the light transmittance of each of display areas of said liquid crystal panel corresponding to each of the divided light emitting areas.

13. The liquid crystal display device as set forth in claim 10, comprising a control circuit for controlling the intensity of light to be emitted from each of the divided light emitting areas of said back-light according to the light transmittance of each of display areas of said liquid crystal panel corresponding to each of the divided light emitting areas.

14. The liquid crystal display device as set forth in claim 1, comprising a control circuit for controlling the intensity of light to be emitted from each of the divided light emitting areas of said back-light in synchronism with scanning of each of said liquid crystal pixels.

15. The liquid crystal display device as set forth in claim 14, comprising a control circuit for controlling the intensity of light to be emitted from each of the divided light emitting areas of said back-light according to the light transmittance of each of display areas of said liquid crystal panel corresponding to each of the divided light emitting areas.

16. The liquid crystal display device as set forth in claim 1, comprising a control circuit for controlling the intensity of light to be emitted from each of the divided light emitting areas of said back-light according to the light transmittance of each of display areas of said liquid crystal panel corresponding to each of the divided light emitting areas.

17. The liquid crystal display device as set forth in claim 1, wherein the light-emitting time of each of said three colored lights is not more than 1/180 second.

18. The liquid crystal display device as set forth in claim 1, wherein said back-light comprises LEDs for emitting three colored lights, respectively, a diffusing plate for diffusing light emitted by said LEDs, and a light guiding plate for guiding light emitted by said LEDs to one face of said liquid crystal panel.

19. The liquid crystal display device as set forth in claim 1, wherein a liquid crystal material of said liquid crystal panel is a ferroelectric liquid crystal material or an antiferroelectric liquid crystal material.

20. A liquid crystal display device as set forth in claim 1, wherein the intensity of light to be emitted from an emitting area located on the downstream side of The scanning direction of each of said liquid crystal pixels is larger than the intensity of light to be emitted from an emitting area located on the upstream side thereof.

* * * * *